US008568119B2

(12) United States Patent
Murono et al.

(10) Patent No.: US 8,568,119 B2
(45) Date of Patent: Oct. 29, 2013

(54) SINGLE SCREW COMPRESSOR

(75) Inventors: Takanori Murono, Sakai (JP); Kaname Ohtsuka, Sakai (JP); Hiromichi Ueno, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 628 days.

(21) Appl. No.: 12/746,136

(22) PCT Filed: Dec. 8, 2008

(86) PCT No.: PCT/JP2008/003650

§ 371 (c)(1),
(2), (4) Date: Jun. 3, 2010

(87) PCT Pub. No.: WO2009/072307

PCT Pub. Date: Jun. 11, 2009

(65) Prior Publication Data

US 2010/0260637 A1 Oct. 14, 2010

(30) Foreign Application Priority Data

Dec. 7, 2007 (JP) ..... 2007-316958

(51) Int. Cl.
*F01C 1/08* (2006.01)

(52) U.S. Cl.
USPC ..... 418/195; 418/189; 418/190

(58) Field of Classification Search
USPC ..... 418/189–190, 195, 201.1, 201.3, 206.1, 418/206.5, 196, 197, 198
See application file for complete search history.

(56) References Cited

U.S. PATENT DOCUMENTS

| | | | | | |
|---|---|---|---|---|---|
| 3,179,330 | A | * | 4/1965 | MacColl | 418/201.1 |
| 3,181,296 | A | * | 5/1965 | Zimmern | 60/39.63 |
| 3,787,154 | A | * | 1/1974 | Edstrom | 418/201.3 |
| 4,105,378 | A | * | 8/1978 | Hodge | 418/195 |
| 4,179,250 | A | * | 12/1979 | Patel | 418/195 |
| 4,342,548 | A | * | 8/1982 | Zimmern | 418/195 |
| 4,470,777 | A | * | 9/1984 | Zimmern | 418/46 |
| 4,594,992 | A | * | 6/1986 | Nakamura et al. | 123/559.1 |
| 4,824,348 | A | * | 4/1989 | Winyard | 418/195 |
| 4,880,367 | A | * | 11/1989 | Bein | 418/107 |
| 4,952,125 | A | * | 8/1990 | Nagai | 418/194 |
| 4,963,079 | A | * | 10/1990 | Fujiwara et al. | 418/83 |
| 5,064,363 | A | * | 11/1991 | Nagai | 418/194 |

(Continued)

FOREIGN PATENT DOCUMENTS

| | | | |
|---|---|---|---|
| CN | 1411538 | A | 4/2003 |
| JP | 60-173382 | A | 9/1985 |
| JP | 2002-202080 | A | 7/2002 |

*Primary Examiner* — Thomas Denion
*Assistant Examiner* — Thomas Olszewski
(74) *Attorney, Agent, or Firm* — Global IP Counselors

(57) ABSTRACT

A single-screw compressor includes a screw rotor including a spiral groove, a casing, and a gate rotor. The gate rotor includes a plurality of radial gates configured to mesh with the spiral groove. A clearance between one of the gates disposed in the spiral groove and a wall surface of a discharge side portion of the spiral groove is larger than a clearance between the gate disposed in the spiral groove and a wall surface of a suction side portion of the spiral groove. The wall surface of the discharge side portion of the spiral groove is a portion extending from a predetermined position of the spiral groove at a certain point in a compression phase to the terminal end of the spiral groove. The wall surface of the suction side portion of the spiral groove being a portion other than the discharge side portion.

2 Claims, 5 Drawing Sheets

(56) References Cited

U.S. PATENT DOCUMENTS 5,129,800 A * 7/1992 Boblitt ..... 418/112
5,782,624 A * 7/1998 Jensen ..... 418/195
6,398,532 B1 * 6/2002 Zha et al. ..... 418/195
7,882,826 B2 * 2/2011 Prior ..... 123/559.1
2004/0037730 A1 2/2004 Ueno et al.
2010/0158737 A1 * 6/2010 Gotou et al. ..... 418/125

* cited by examiner

SINGLE SCREW COMPRESSOR

CROSS-REFERENCE TO RELATED APPLICATIONS

This U.S. National stage application claims priority under 35 U.S.C. §119(a) to Japanese Patent Application No. 2007-316958, filed in Japan on Dec. 7, 2007, the entire contents of which are hereby incorporated herein by reference.

TECHNICAL FIELD

The present invention relates to a measure for improving the efficiency of a single-screw compressor.

BACKGROUND ART

Single-screw compressors have been used in the art as compressors for compressing refrigerant or air. For example, Japanese Published Patent Application No. 2002-202080 discloses a single-screw compressor including a screw rotor and two gate rotors.

The single-screw compressor will be described. The screw rotor is formed generally in a cylindrical shape with a plurality of spiral grooves cut in the outer circumferential portion thereof. Each gate rotor is formed generally in a flat plate shape and arranged beside the screw rotor. The gate rotor is provided with a plurality of rectangular plate-shaped gates arranged in a radial pattern. The gate rotor is installed in such an orientation that the rotation axis thereof is perpendicular to the rotation axis of the screw rotor, with the gates meshed with the spiral grooves of the screw rotor.

In the single-screw compressor, the screw rotor and the gate rotors are accommodated in the casing, and a compression chamber is formed by the spiral grooves of the screw rotor, the gates of the gate rotors, and the inner wall surface of the casing. As the screw rotor is rotated by an electric motor, etc., the gate rotor is rotated by the rotation of the screw rotor. Then, the gates of the gate rotors relatively move from the start end (the suction side end portion) to the terminal end (the discharge side end portion) of a meshing spiral groove, thereby gradually reducing the volume of the closed compression chamber. As a result, the fluid in the compression chamber is compressed.

SUMMARY

Technical Problem

In a single-screw compressor, in a process of compressing a gas in the compression chamber, the temperature of the gas increases as the pressure of the gas increases. Therefore, in the spiral groove of the screw rotor, the temperature is higher in an area near the start end thereof than in an area near the terminal end thereof. That is, in a single-screw compressor in operation, the screw rotor is at a higher temperature in an area near the discharge side end portion than in an area near the suction side end portion.

Therefore, if the clearance of the screw rotor and the gate under a cold condition is constant from the start end to the terminal end of the spiral groove, the screw rotor thermally expands during operation in an area near the discharge side end portion of the screw rotor, and therefore the screw rotor and the gate may be in contact with each other, thus wearing the gate. As a result, in an area of the screw rotor near the suction side end portion, the clearance between the screw rotor and the gate becomes excessive, and the amount of the gas leaking from the gap therebetween may become excessive, thus leading to a decrease in the efficiency of the single-screw compressor.

The present invention has been made in view of such problems, and has an object to improve the efficiency of a single-screw compressor by reducing the wear of the gates.

Solution to the Problem

A first aspect is directed to a single-screw compressor including: a screw rotor (40) including a spiral groove (41) in a spiral pattern formed on an outer circumferential portion thereof; a casing (10) accommodating the screw rotor (40); and a gate rotor (50) including a plurality of gates (51) formed in a radial pattern which are to be meshed with the spiral groove (41) of the screw rotor (40), the single-screw compressor compressing a fluid in a compression chamber (23) defined by the screw rotor (40), the casing (10) and the gates (51), by means of the gate (51) relatively moving from a start end of the spiral groove (41) toward a terminal end thereof A clearance between the gate (51) and a wall surface of a discharge side portion (46) of the spiral groove (41) which is a portion extending from a predetermined position of the spiral groove (41) at a certain point in a compression phase to the terminal end thereof is larger than a clearance between the gate (51) and a wall surface of a suction side portion (45) of the spiral groove (41) which is a portion other than the discharge side portion (46).

In the first aspect, the gates (51) of the gate rotor (50) are meshed with the spiral grooves (41) of the screw rotor (40). When the screw rotor (40) and the gate rotor (50) rotate, the gate (51) relatively moves from the start end of the spiral groove (41) toward the terminal end thereof, thereby compressing the fluid in the compression chamber (23). In the spiral groove (41) of the screw rotor (40), a portion extending from a predetermined position at a certain point in the compression phase to the terminal end serves as the discharge side portion (46), with the remaining portion serving as the suction side portion (45). In the process of relatively moving from the start end toward the terminal end of the spiral groove (41), the gate (51) first moves along the wall surface of the suction side portion (45), and then moves along the wall surface of the discharge side portion (46). While the gate (51) relatively moves from the start end of the spiral groove (41) toward the terminal end thereof, the internal pressure of the compression chamber (23) gradually increases, thereby gradually increasing the gas temperature in the compression chamber (23) accordingly. Therefore, the screw rotor (40) is at a higher temperature in a portion thereof near the terminal end of the spiral groove (41) than in a portion thereof near the start end of the spiral groove (41).

In the single-screw compressor (1) in operation, the screw rotor (40) thermally expands. The amount of thermal expansion of the screw rotor (40) is larger for a portion where the temperature of the screw rotor (40) is higher. That is, the amount of thermal expansion of the screw rotor (40) is larger in a portion near the terminal end of the spiral groove (41) than in a portion near the start end of the spiral groove (41). When the screw rotor (40) thermally expands, the clearance between the wall surface of the spiral groove (41) and the gate (51) is narrowed. Therefore, in the spiral groove (41), the amount of decrease in the clearance between the wall surface of the discharge side portion (46) and the gate (51) is larger than the amount of decrease in the clearance between the wall surface of the suction side portion (45) and the gate (51).

In contrast, in the first aspect, the clearance between the wall surface of the discharge side portion (46) of the spiral groove (41) and the gate (51) is made in advance larger than the clearance between the wall surface of the suction side portion (45) of the spiral groove (41) and the gate (51). Therefore, the clearance between the wall surface of the discharge side portion (46) of the spiral groove (41) and the gate (51) is ensured even in a state where the screw rotor (40) is thermally expanded during the operation of the single-screw compressor (1).

A second aspect is according to the first aspect, wherein the clearance between the wall surface of the discharge side portion (46) of the spiral groove (41) and the gate (51) gradually increases as the gate (51) comes closer to the terminal end of the spiral groove (41).

Here, since the gas temperature in the compression chamber (23) is higher toward the terminal end of the spiral groove (41), the screw rotor (40) is also at a higher temperature in a portion closer to the terminal end of the spiral groove (41). Therefore, the amount of decrease in the clearance between the wall surface of the spiral groove (41) and the gate (51) increases toward the terminal end of the spiral groove (41).

In contrast, in the second aspect, the clearance between the wall surface of the discharge side portion (46) of the spiral groove (41) and the gate (51) gradually increases toward the terminal end of the spiral groove (41). Therefore, the clearance between the wall surface of the spiral groove (41) and the gate (51) is minimized while ensuring the clearance therebetween.

A third aspect is according to the first aspect, wherein a clearance between a side wall surface (42,43) of the discharge side portion (46) of the spiral groove (41) and a side surface of the gate (51) is larger than a clearance between the side wall surface (42,43) of the suction side portion (45) of the spiral groove (41) and the side surface of the gate (51).

In the third aspect, in the discharge side portion (46) of the spiral groove (41), the clearance between the side wall surface (42,43) and the side surface of the gate (51) is ensured. Therefore, even in a state where the screw rotor (40) is thermally expanded, the clearance between the side wall surface (42,43) and the side surface of the gate (51) is ensured across the entire length of the spiral groove (41), thereby reducing the wear of the gate (51) and reducing the power consumed by the friction between the screw rotor (40) and the gate (51).

A fourth aspect is according to the third aspect, wherein a clearance between a bottom wall surface (44) of the discharge side portion (46) of the spiral groove (41) and a tip surface of the gate (51) is larger than a clearance between the bottom wall surface (44) of the suction side portion (45) of the spiral groove (41) and the tip surface of the gate (51).

In the fourth aspect, in the discharge side portion (46) of the spiral groove (41), the clearance between the bottom wall surface (44) and the tip surface of the gate (51) is ensured. Therefore, even in a state where the screw rotor (40) is thermally expanded, the clearance between the bottom wall surface (44) and the tip surface of the gate (51) is ensured across the entire length of the spiral groove (41), thereby reducing the wear of the gate (51) and reducing the power consumed by the friction between the screw rotor (40) and the gate (51).

Advantages of the Invention

In the present invention, the clearance between the wall surface of the discharge side portion (46) of the spiral groove (41) and the gate (51) is made in advance larger than the clearance between the wall surface of the suction side portion (45) of the spiral groove (41) and the gate (51). Therefore, even in a state where the screw rotor (40) is thermally expanded during the operation of the single-screw compressor (1), it is possible to ensure the clearance between the wall surface of the discharge side portion (46) of the spiral groove (41) and the gate (51). As a result, it is possible to reduce the wear of the gate (51) due to the contact with the screw rotor (40), and it is therefore possible to improve the efficiency of the single-screw compressor (1) by reducing the amount of leakage of the gas from the compression chamber (23).

While there is a frictional loss occurring if the gate (51) is in direct contact with the wall surface of the discharge side portion (46) of the spiral groove (41), it is possible in the present invention to ensure the clearance between the wall surface of the discharge side portion (46) of the spiral groove (41) and the gate (51), thereby reducing the frictional loss between the screw rotor (40) and the gate (51) to be low. Therefore, according to the present invention, it is possible to improve the efficiency of the single-screw compressor (1) also by reducing the frictional loss between the screw rotor (40) and the gate (51).

In the second aspect described above, the clearance between the wall surface of the discharge side portion (46) of the spiral groove (41) and the gate (51) gradually increases toward the terminal end of the spiral groove (41). Therefore, it is possible to minimize the clearance between the wall surface of the spiral groove (41) and the gate (51) while ensuring the clearance therebetween, and it is therefore possible to further reduce the amount of leakage of the gas from the compression chamber (23).

DESCRIPTION OF EMBODIMENTS

An embodiment of the present invention will now be described in detail with reference to the drawings.

A single-screw compressor (1) of the present embodiment (hereinafter, referred to simply as a screw compressor) is provided in a refrigerant circuit for performing a refrigeration cycle and is for compressing refrigerant.

Figure 1:
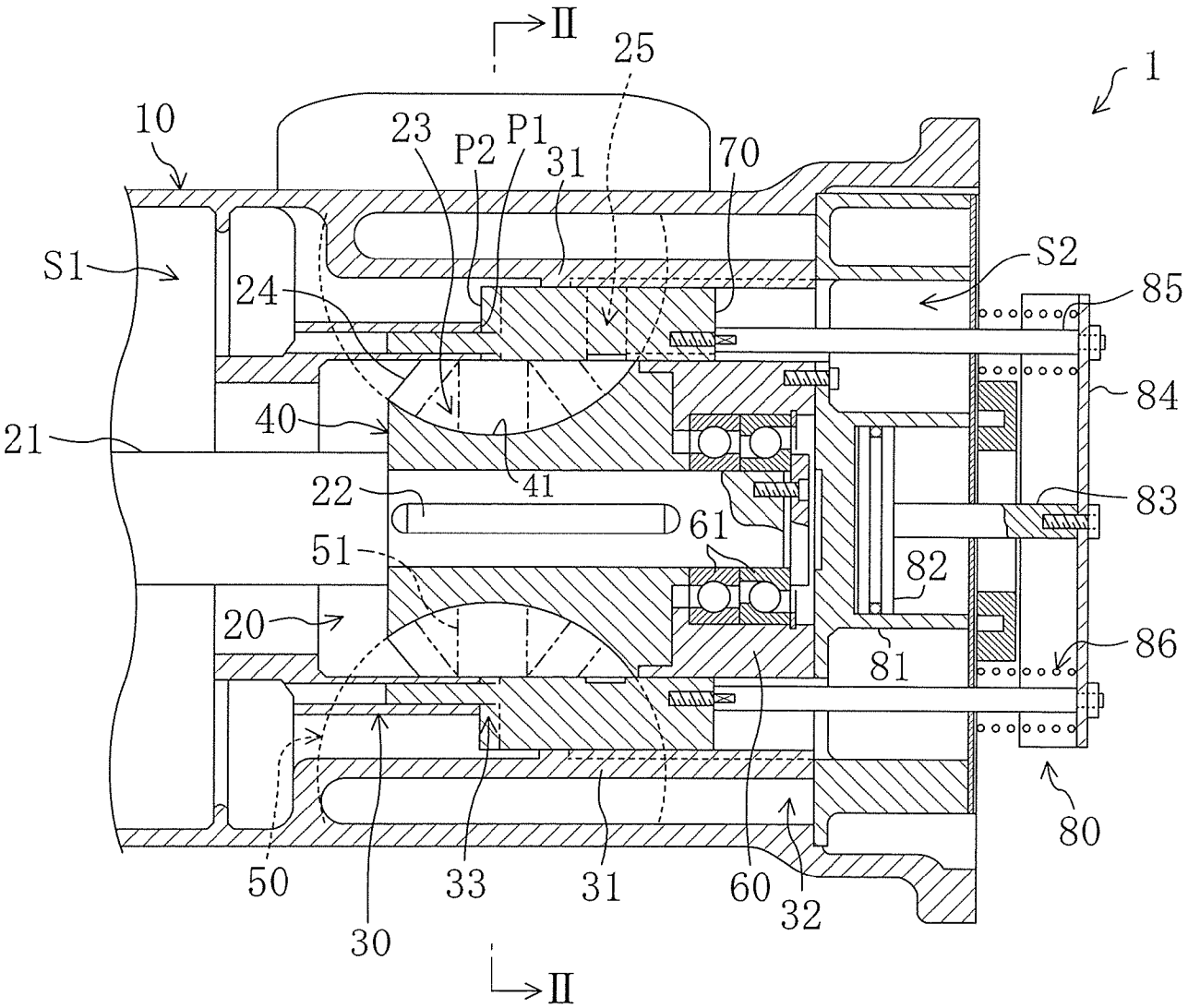
FIG. 1 is a vertical cross-sectional view showing a configuration of a part of a single-screw compressor.
Figure 2:
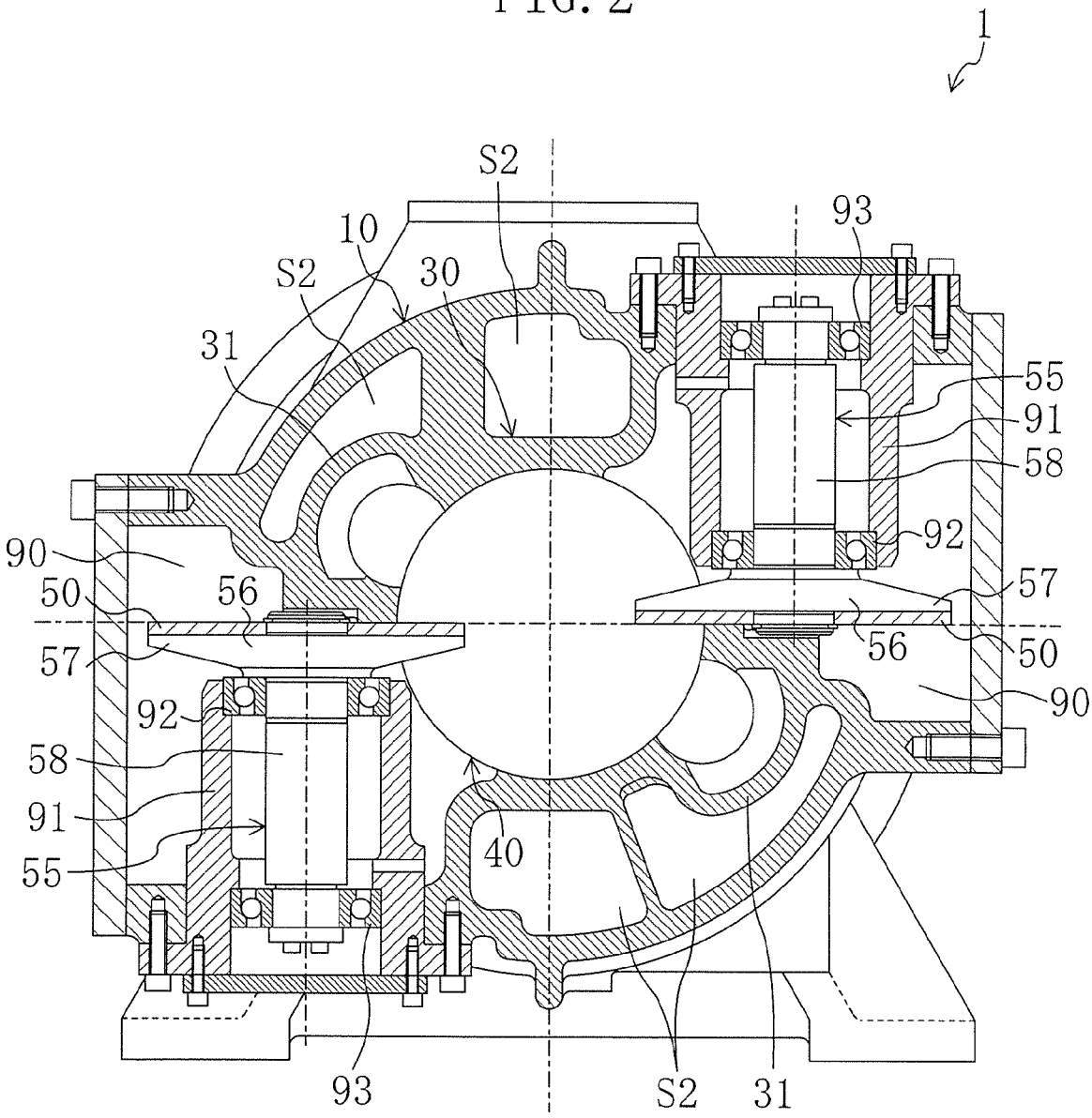
FIG. 2 is a horizontal cross-sectional view taken along line II-II of FIG. 1.

As shown in FIG. 1 and FIG. 2, the single-screw compressor (1) has a semi-hermetic configuration. In the single-screw compressor (1), a compression mechanism (20) and an electric motor for driving the same are accommodated in one casing (10). The compression mechanism (20) is coupled to the electric motor via a drive shaft (21). In FIG. 1, the electric motor is not shown. Defined in the casing (10) are a low pressure space (S1) into which a low pressure gas refrigerant is introduced from an evaporator of the refrigerant circuit and which guides the low pressure gas into the compression mechanism (20), and a high pressure space (S2) into which the high pressure gas refrigerant discharged from the compression mechanism (20) flows.

The compression mechanism (20) includes a cylindrical wall (30) formed in the casing (10), one screw rotor (40) arranged in the cylindrical wall (30), and two gate rotors (50) meshed with the screw rotor (40). The drive shaft (21) is inserted through the screw rotor (40). The screw rotor (40) and the drive shaft (21) are coupled together by a key (22). The drive shaft (21) is arranged on the same axis with the screw rotor (40). The tip portion of the drive shaft (21) is rotatably supported by a bearing holder (60) located on the high pressure side (on the right side of FIG. 1 where the axial direction of the drive shaft (21) is taken as the left-right direction) of the compression mechanism (20). The bearing holder (60) supports the drive shaft (21) via a ball bearing (61).

Figure 3:
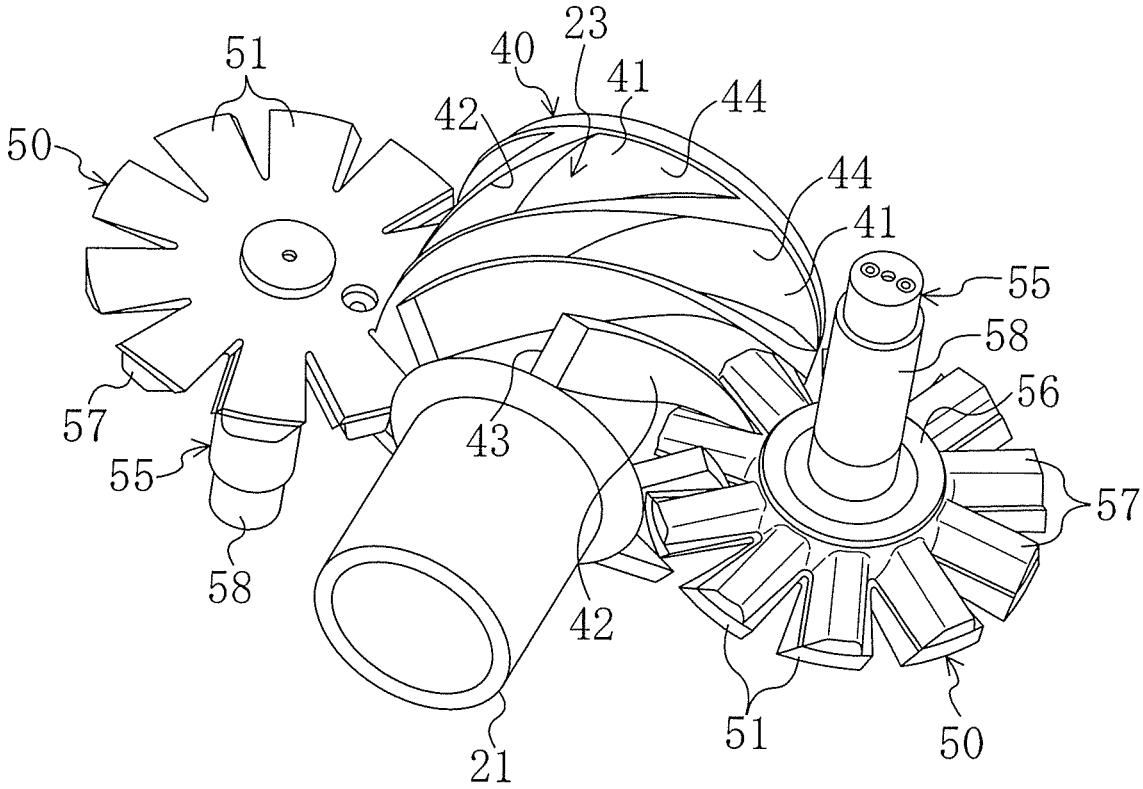
FIG. 3 is a perspective view showing, isolated, a main part of a single-screw compressor.
Figure 4:
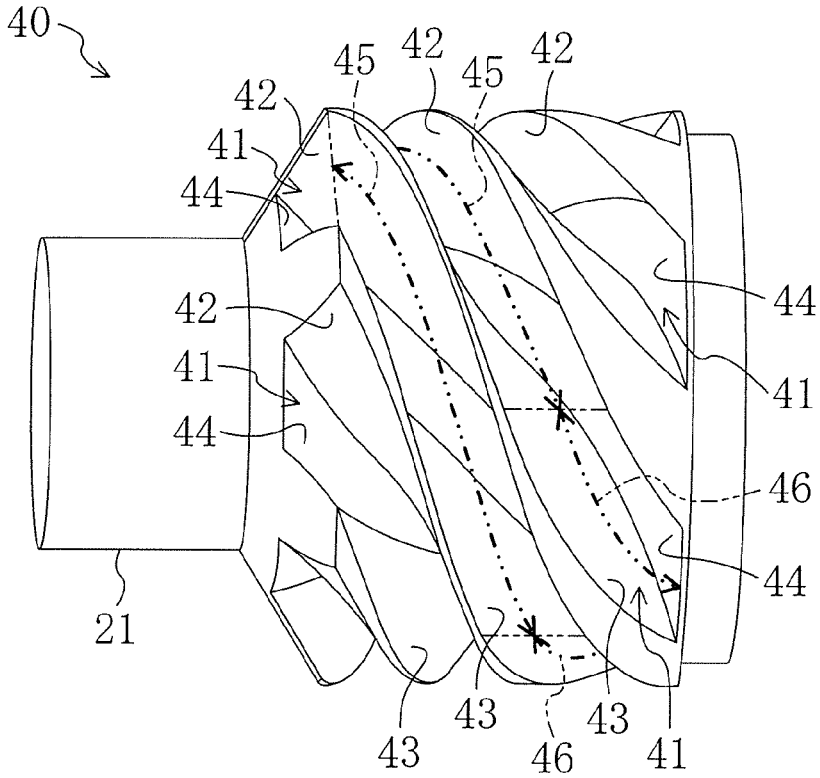
FIG. 4 is a perspective view showing a screw rotor of a single-screw compressor.

As shown in FIG. 3 and FIG. 4, the screw rotor (40) is a metal member formed generally in a cylindrical shape. The screw rotor (40) rotatably fits in the cylindrical wall (30), with the outer circumferential surface thereof sliding against the inner circumferential surface of the cylindrical wall (30). A plurality of (six in the present embodiment) spiral grooves (41) are formed so as to extend in a spiral pattern from one end of the screw rotor (40) toward the other end thereof on the outer circumferential portion of the screw rotor (40).

The start end of each spiral groove (41) of the screw rotor (40) is the left end in FIG. 4, and the terminal end thereof is the right end in the figure. The left end portion (the suction side end portion) of the screw rotor (40) is tapered. In the screw rotor (40) shown in FIG. 4, the start end of the spiral groove (41) is opened at the left end surface of the tapered portion, whereas the terminal end of the spiral groove (41) is not opened at the right end surface.

Of the opposing side wall surfaces (42,43) of the spiral groove (41), one that is located on the front side (on the right side in FIG. 4) in the moving direction of the gate (51) is the first side wall surface (42), and one that is located on the rear side (on the left side in the figure) in the moving direction of the gate (51) is the second side wall surface (43). Each spiral groove (41) includes a suction side portion (45) and a discharge side portion (46). This will be described later.

Each gate rotor (50) is a resin member. Each gate rotor (50) includes a plurality of (eleven in the present embodiment) gates (51) each formed in a rectangular plate shape and arranged in a radial pattern. The gate rotors (50) are arranged on the outer side of the cylindrical wall (30) so that they are axially symmetrical with each other about the rotation axis of the screw rotor (40). That is, in the screw compressor (1) of the present embodiment, two gate rotors (50) are arranged at an equal angular interval (180° interval in the present embodiment) about the rotation center axis of the screw rotor (40). The axis of each gate rotor (50) is perpendicular to the axis of the screw rotor (40). Each gate rotor (50) is arranged so that the gates (51) are meshed with the spiral grooves (41) of the screw rotor (40) by penetrating a portion of the cylindrical wall (30).

The gate rotor (50) is attached to a metal rotor supporting member (55) (see FIG. 3). The rotor supporting member (55) includes a base portion (56), an arm portion (57), and a shaft portion (58). The base portion (56) is formed in a slightly thicker disc shape. A number of arm portions (57), equal to the number of gates (51) of the gate rotor (50), are provided so as to extend radially outwardly from the outer circumferential surface of the base portion (56). The shaft portion (58) is formed in a rod shape, and is provided so as to stand on the base portion (56). The center axis of the shaft portion (58) coincides with the center axis of the base portion (56). The gate rotor (50) is attached to one surface of the base portion (56) and the arm portion (57) that is opposite to the shaft portion (58). Each arm portion (57) is in contact with the back surface of a gate (51).

The rotor supporting member (55), to which the gate rotor (50) is attached, is accommodated in a gate rotor chamber (90) defined in the casing (10) adjacent to the cylindrical wall (30) (see FIG. 2). The rotor supporting member (55) arranged on the right side of the screw rotor (40) in FIG. 2 is provided in such an orientation that the gate rotor (50) is on the lower side. On the other hand, the rotor supporting member (55) arranged on the left side of the screw rotor (40) in the figure is arranged in such an orientation that the gate rotor (50) is on the upper side. The shaft portion (58) of each rotor supporting member (55) is rotatably supported by a bearing housing (91) in the gate rotor chamber (90) via a ball bearing (92,93). Note that each gate rotor chamber (90) communicates with the low pressure space (S1).

In the compression mechanism (20), the space limited by the inner circumferential surface of the cylindrical wall (30), the spiral grooves (41) of the screw rotor (40), and the gates (51) of the gate rotor (50) serves as the compression chamber (23). The spiral grooves (41) of the screw rotor (40) are opened into the low pressure space (S1) at the suction side end portion thereof, and the opening area serves as a suction port (24) of the compression mechanism (20).

The screw compressor (1) includes slide valves (70) as capacity control mechanisms. The slide valves (70) are provided in slide valve accommodating portions (31) which are the cylindrical wall (30) bulging radially outwardly at two locations in the circumferential direction of the cylindrical wall (30). The inner surface of the slide valve (70) forms a part of the inner circumferential surface of the cylindrical wall (30), and the slide valve (70) is slidable in the axial direction of the cylindrical wall (30).

When the slide valve (70) is slid toward the high pressure space (S2) (toward the right side of FIG. 1 where the axial direction of the drive shaft (21) is taken as the left-right direction), and an axial gap is formed between an end surface (P1) of the slide valve accommodating section (31) and an end surface (P2) of the slide valve (70). This axial gap serves as a bypass passage (33) for returning the refrigerant from the compression chamber (23) into the low pressure space (S1). When the slide valve (70) is moved around to change the degree of the opening of the bypass passage (33), the capacity of the compression mechanism (20) changes. The slide valve (70) includes a discharge port (25) for communicating the compression chamber (23) and the high pressure space (S2) with each other.

The screw compressor (1) includes a slide valve driving mechanism (80) for sliding the slide valve (70). The slide valve driving mechanism (80) includes a cylinder (81) fixed to the bearing holder (60), a piston (82) inserted in the cylinder (81), and an arm (84) connected to a piston rod (83) of the piston (82), a connection rod (85) for connecting together the arm (84) and the slide valve (70), and a spring (86) for urging the arm (84) to the right in FIG. 1 (in such a direction that the arm (84) is pulled away from the casing (10)).

With the slide valve driving mechanism (80) shown in FIG. 1, the inner pressure of the space on the left of the piston (82) (the space on one side of the piston (82) that is closer to the screw rotor (40)) is higher than the inner pressure of the space on the right of the piston (82) (the space on one side of the piston (82)) that is closer to the arm (84)). The slide valve driving mechanism (80) is configured so that the position of the slide valve (70) is adjusted by adjusting the inner pressure of the space on the right of the piston (82) (that is, the gas pressure in the right side space).

During the operation of the screw compressor (1), the suction pressure of the compression mechanism (20) acts on one end surface of the slide valve (70) in the axial direction, and the discharge pressure of the compression mechanism (20) acts on the other end surface thereof. Therefore, during the operation of the screw compressor (1), there is always a force acting on the slide valve (70) in such a direction as to push the slide valve (70) toward the low pressure space (S1). Therefore, if one changes the inner pressure of the space on the left and the inner pressure of the space on the right of the piston (82) in the slide valve driving mechanism (80), it changes the magnitude of the force in such a direction as to pull back the slide valve (70) toward the high pressure space (S2), thereby changing the position of the slide valve (70).

As described above, each spiral groove (41) of the screw rotor (40) includes the suction side portion (45) and the discharge side portion (46). The suction side portion (45) and the discharge side portion (46) will be described with reference to FIG. 4 and FIG. 5. Note that FIG. 5 shows a state where a gate (51*a*) is located in the suction side portion (45) of the spiral groove (41), and a gate (51*b*) is located in the discharge side portion (46) of the spiral groove (41).

As shown in FIG. 4, a portion of each spiral groove (41) extending from the start end thereof to a position corresponding to a certain point in the compression phase serves as the suction side portion (45), with the remaining portion (i.e., a portion thereof extending from the certain point in the compression phase to the terminal end thereof) serving as the discharge side portion (46). That is, in each spiral groove (41), the area up to the point where the compression chamber (23) becomes closed and an area corresponding to a portion of the compression phase serve as the suction side portion (45), and the rest of the compression phase and the area corresponding to the entire discharge phase serve as the discharge side portion (46).

Note that in each spiral groove (41), the portion corresponding to the compression phase means a portion from a position of the gate (51) at a point in time when the compression chamber (23) becomes closed by being partitioned from the low pressure space (S1) by the gate (51) to another position of the gate (51) immediately before the compression chamber (23) starts to communicate with the discharge port (25). In each spiral groove (41), the portion corresponding to the discharge phase means a portion from a position of the gate (51) at a point in time when the compression chamber (23) starts to communicate with the discharge port (25) to the terminal end of the spiral groove (41).

Figure 5:
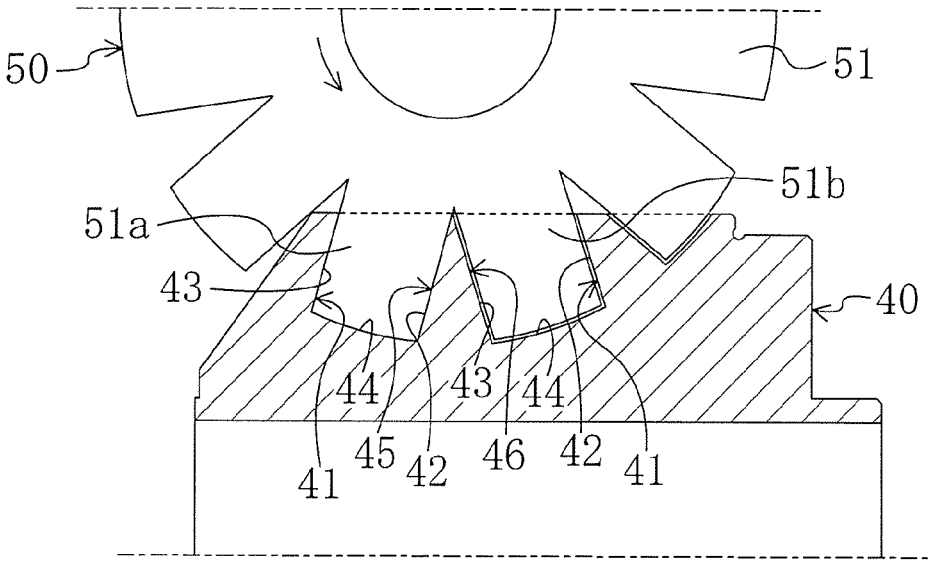
FIG. 5 is a cross-sectional view showing a cross section of a main part of the single-screw compressor taken along a plane that passes through the rotation axis of the screw rotor.

As shown in FIG. 5, in the suction side portion (45) of each spiral groove (41), there is almost zero clearance between the opposing side wall surfaces (42,43) and a bottom wall surface (44) and the gate (51). That is, in the suction side portion (45), the wall surface (42,43,44) of the spiral groove (41) and the gate (51) are substantially in contact with each other. Specifically, in the suction side portion (45) of the spiral groove (41), the width of the spiral groove (41) in the cross section (the cross section shown in FIG. 5) passing through the rotation axis of the screw rotor (40) substantially coincides with the width of the gate (51). In this suction side portion (45), the distance from the rotation axis of the gate rotor (50) to the bottom wall surface (44) of the spiral groove (41) substantially coincides with the distance from the rotation axis of the gate rotor (50) to the tip surface of the gate (51).

Note however that in the suction side portion (45) of the spiral groove (41), the wall surface (42,43,44) of the spiral groove (41) and the gate (51) do not need to be in physical contact with each other, and there is no problem even if there is a minute gap therebetween. As long as the gap therebetween is such that it can be sealed with an oil film made of lubricant, the hermeticity of the compression chamber (23) is maintained even if they are not in physical contact with each other.

In the discharge side portion (46) of each spiral groove (41), the clearance between the opposing side wall surfaces (42,43) and the gate (51) is larger than the clearance between the side wall surface (42,43) of the suction side portion (45) and the gate (51). The clearance between the side wall surface (42,43) of the discharge side portion (46) and the gate (51) gradually increases toward the terminal end of the spiral groove (41). Specifically, in the discharge side portion (46) of the spiral groove (41), the width of the spiral groove (41) in the cross section (the cross section shown in FIG. 5) passing through the rotation axis of the screw rotor (40) is somewhat larger than the width of the gate (51) and gradually increases toward the terminal end of the spiral groove (41).

In the discharge side portion (46) of each spiral groove (41), the clearance between the bottom wall surface (44) and the gate (51) is larger than the clearance between the bottom wall surface (44) of the suction side portion (45) and the gate (51). The clearance between the bottom wall surface (44) of the discharge side portion (46) and the gate (51) gradually increases as the gate (51) moves toward the terminal end of the spiral groove (41). Specifically, in the discharge side portion (46) of the spiral groove (41), the distance from the rotation axis of the gate rotor (50) to the bottom wall surface (44) of the spiral groove (41) is somewhat larger than the distance from the rotation axis of the gate rotor (50) to the tip surface of the gate (51) and gradually increases toward the terminal end of the spiral groove (41).

Note that the shape of the screw rotor (40) described above is that in a state where the temperature of the screw rotor (40) is generally equal to the temperature of the place where the screw compressor (1) is installed (i.e., under a cold condition). During the operation of the screw compressor (1), the temperature of the screw rotor (40) increases as compared with that when standing, and the screw rotor (40) thermally expands. The temperature of the portion (the right end portion in FIG. 4) of the screw rotor (40) near the terminal end of the spiral groove (41) is higher than the temperature of the portion (the left end portion in the figure) near the start end of the spiral groove (41). Therefore, the clearance between the screw rotor (40) and the gate (51) when the screw compressor (1) is operating is different from that when it is standing. This will be discussed later.

Operation

An operation of the screw compressor (1) will be described.

Figure 6:
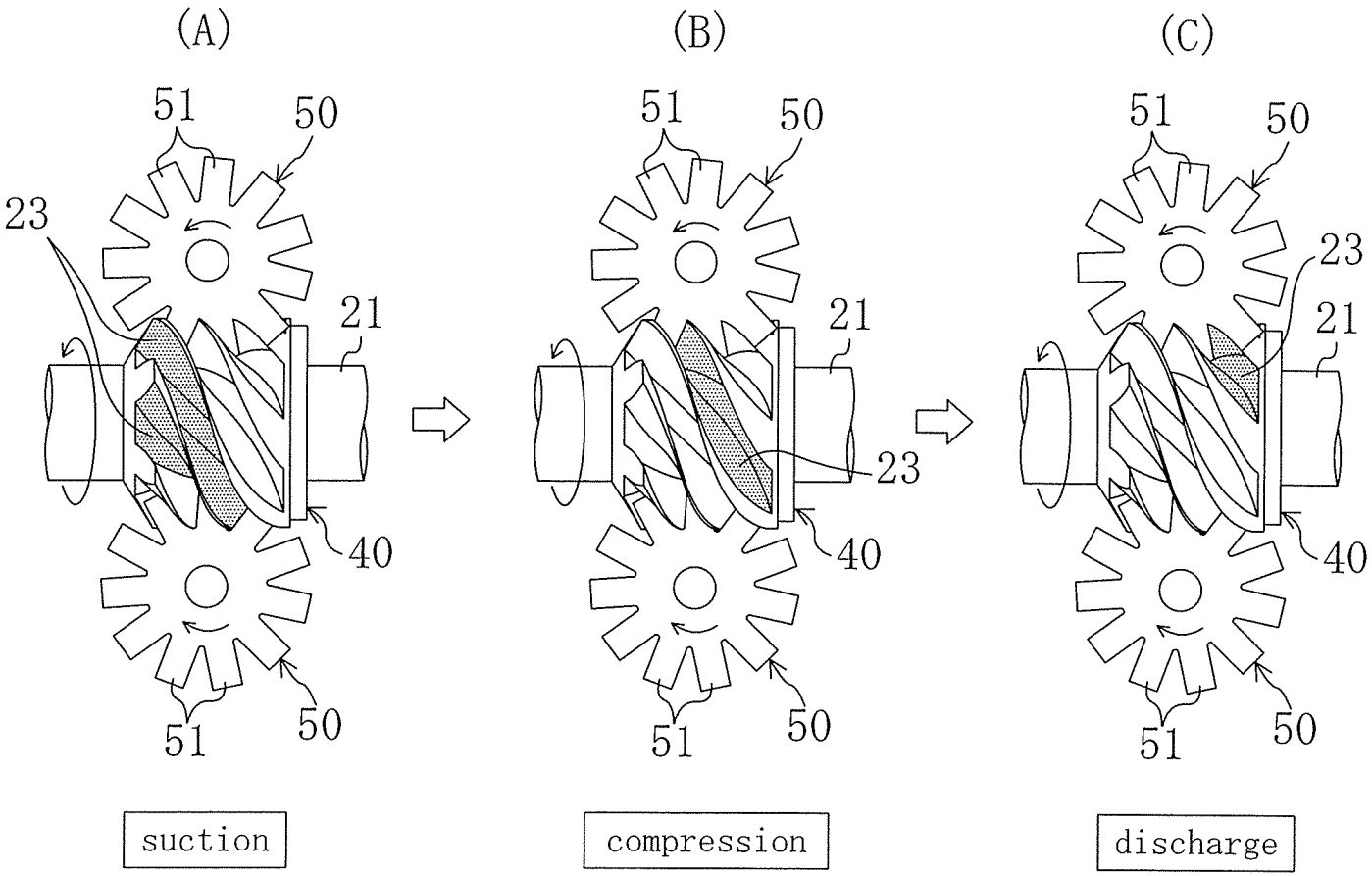
FIG. 6 shows plan views showing operations of a compression mechanism of a single-screw compressor, wherein (A) shows a suction phase, (B) shows a compression phase, and (C) shows a discharge phase.

When the electric motor is started in the screw compressor (1), the screw rotor (40) rotates, following the rotation of the drive shaft (21). The gate rotor (50) also rotates, following the rotation of the screw rotor (40), and the compression mechanism (20) repeats the suction phase, the compression phase, and the discharge phase. Here, the description will be made with a particular attention to the compression chamber (23) dotted in FIG. 6.

In FIG. 6(A), the dotted compression chamber (23) communicates with the low pressure space (S1). The spiral groove (41) in which the compression chamber (23) is formed is meshed with the gate (51) of the gate rotor (50) located on the lower side of the figure. When the screw rotor (40) rotates, the gate (51) relatively moves toward the terminal end of the spiral groove (41), and the volume of the compression chamber (23) increases accordingly. As a result, the low pressure gas refrigerant of the low pressure space (S1) is sucked into the compression chamber (23) through the suction port (24).

When the screw rotor (40) further rotates, it will be in a state of FIG. 6(B). In this figure, the dotted compression chamber (23) is in a closed state. That is, the spiral groove (41) in which the compression chamber (23) is formed is meshed with the gate (51) of the gate rotor (50) located on the upper side of the figure, and is partitioned from the low pressure space (S1) by the gate (51). Then, as the gate (51) moves toward the terminal end of the spiral groove (41), following the rotation of the screw rotor (40), the volume of the compression chamber (23) gradually decreases. As a result, the gas refrigerant in the compression chamber (23) is compressed.

When the screw rotor (40) further rotates, it will be in a state of FIG. 6(C). In the figure, the dotted compression chamber (23) is in a state where it communicates with the high pressure space (S2) via the discharge port (25). Then, as the gate (51) moves toward the terminal end of the spiral groove (41), following the rotation of the screw rotor (40), the compressed refrigerant gas is pushed out into the high pressure space (S2) from the compression chamber (23).

As described above, in the compression phase of the compression mechanism (20), the gate (51) relatively moves toward the terminal end of the spiral groove (41), and the pressure of the gas refrigerant in the compression chamber (23) gradually increases accordingly. Therefore, the temperature of the gas refrigerant in the compression chamber (23) is higher toward the terminal end of the spiral groove (41), and the temperature of the screw rotor (40) is also higher in a portion closer to the terminal end of the spiral groove (41).

As a result, the amount of thermal expansion of the screw rotor (40) increases toward the terminal end of the compression phase of the spiral groove (41). When the screw rotor (40) thermally expands, the clearance between the wall surface (42,43,44) of the spiral groove (41) and the gate (51) decreases, and the amount of decrease in the clearance therebetween increases toward the terminal end of the compression phase of the spiral groove (41).

In contrast, in the compression mechanism (20) of the present embodiment, the clearance between the wall surface (42,43,44) of the spiral groove (41) and the gate (51) under a cold condition increases toward the terminal end of the compression phase of the spiral groove (41). Therefore, the clearance between the screw rotor (40) and the gate (51) is ensured even if the temperature of the screw rotor (40) increases during the operation of the screw compressor (1), thereby decreasing the clearance between the wall surface (42,43,44) of the spiral groove (41) and the gate (51) in a portion close to the terminal end of the spiral groove (41) of the screw rotor (40).

Advantages of Embodiment

In the present embodiment, the clearance between the wall surface of the discharge side portion (46) of the spiral groove (41) and the gate (51) is made in advance larger than the clearance between the wall surface of the suction side portion (45) of the spiral groove (41) and the gate (51). Therefore, even if the screw rotor (40) thermally expands during the operation of the screw compressor (1), it is possible to ensure the clearance between the wall surface of the discharge side portion (46) of the spiral groove (41) and the gate (51). As a result, it is possible to reduce the wear of the gate (51) due to the contact with the screw rotor (40).

Here, if the gate (51) wears down, in an area near the start end of the compression phase of the screw rotor (40) where the amount of thermal expansion is not so large, the clearance between the wall surface (42,43,44) of the spiral groove (41) and the gate (51) may increase, thereby increasing the amount of leakage of the gas from the compression chamber (23). In contrast, in the present embodiment, the wear of the gate (51) can be reduced as described above. Therefore, with the present embodiment, it is possible to reduce the amount of leakage of the gas from the compression chamber (23), and it is therefore possible to improve the efficiency of the screw compressor (1).

If the gate (51) is in direct contact with the wall surface of the discharge side portion (46) of the spiral groove (41), a frictional loss occurs. In the present embodiment, however, it is possible to ensure the clearance between the wall surface of the discharge side portion (46) of the spiral groove (41) and the gate (51), and it is therefore possible to reduce the frictional loss between the screw rotor (40) and the gate (51) to be low. Therefore, with the present embodiment, it is possible to improve the efficiency of the screw compressor (1) also by reducing the frictional loss between the screw rotor (40) and the gate (51).

In the present embodiment, the clearance between the wall surface of the discharge side portion (46) of the spiral groove (41) and the gate (51) gradually increases toward the terminal end of the spiral groove (41). Therefore, it is possible to minimize the clearance between the wall surface of the spiral groove (41) and the gate (51) while ensuring the clearance therebetween, and it is therefore possible to further reduce the amount of leakage of the gas from the compression chamber (23).

Variation 1 of Embodiment

In the screw rotor (40) of the embodiment above, a gap is formed between the side wall surface (42,43) of the discharge side portion (46) of the spiral groove (41) and the side surface of the gate (51), and the gap is also formed between the bottom wall surface (44) of the discharge side portion (46) and the tip surface of the gate (51). In contrast, the clearance between the bottom wall surface (44) of the discharge side portion (46) and the tip surface of the gate (51) may be set to substantially zero, while forming a gap between the side wall surface (42,43) of the discharge side portion (46) of the spiral groove (41) and the side surface of the gate (51). Also in such a case, the wear of the side surface of the gate (51) due to the contact with the side wall surface (42,43) of the spiral groove (41) is reduced, and it is therefore possible to reduce the amount of leakage of the gas from the compression chamber (23) as compared with the conventional technique, thereby improving the efficiency of the screw compressor (1).

Variation 2 of Embodiment

In the screw rotor (40) of the embodiment above, the clearance between the wall surface (42,43,44) of the discharge side portion (46) of the spiral groove (41) and the gate (51) does not have to vary across the entire length of the discharge side portion (46). That is, in the screw rotor (40), in a portion of the discharge side portion (46) of the spiral groove (41), the clearance between the wall surface (42,43,44) and the gate (51) may gradually increase toward the terminal end of the spiral groove (41).

In the compression mechanism (20), the temperature of the gas refrigerant in the compression chamber (23) increases toward the terminal end of the spiral groove (41) in the compression phase, but the temperature of the gas refrigerant in the compression chamber (23) is generally constant in the discharge phase. Therefore, the amount of decrease in the clearance between the wall surface (42,43,44) of the spiral groove (41) and the gate (51) due to the thermal expansion of the screw rotor (40) gradually increases up to a position of the spiral groove (41) corresponding to the terminal end of the compression phase, but is generally constant in an area of the spiral groove (41) corresponding to the discharge phase. Therefore, the shape of the screw rotor (40) under a cold condition may be such that the clearance between the wall surface (42,43,44) of the spiral groove (41) and the gate (51) gradually increases in an area of the spiral groove (41) from the start end of the discharge side portion (46) to the vicinity of the position corresponding to the terminal end of the compression phase, whereas the clearance between the wall surface (42,43,44) of the spiral groove (41) and the gate (51) is kept constant in an area of the spiral groove (41) from the vicinity of the position corresponding to the terminal end of the compression phase to the terminal end thereof.

Note that the embodiment described above is essentially a preferred embodiment, and is not intended to limit the scope of the present invention, the applications thereof, or the uses thereof.

INDUSTRIAL APPLICABILITY

As describe above, the present invention is useful for a single-screw compressor.

What is claimed is:

1. A single-screw compressor configured to compress a fluid in a compression chamber, the single-screw compressor comprising:

a screw rotor including a spiral groove formed in a spiral pattern on an outer circumferential portion thereof;

a casing accommodating the screw rotor; and a gate rotor including a plurality of gates formed in a radial pattern, the gates being configured and arranged to mesh with the spiral groove of the screw rotor, the compression chamber being defined by the screw rotor, the casing and the gates such that the fluid is compressed in the compression chamber when one of the gates relatively moves from a start end of the spiral groove toward a terminal end of the spiral groove in the spiral groove, in the spiral groove, a discharge side portion is a portion extending from a predetermined position of the spiral groove at a certain point in a compression phase to the terminal end thereof, and a suction side portion is a portion other than the discharge side portion, a clearance between a side wall surface of the suction side portion and a side surface of the gate is constant, a clearance between a side surface of the gate and a side wall surface of the discharge side portion of the spiral groove being larger than a clearance between the side surface of the gate the side wall surface of the suction side portion of the spiral groove, and the clearance between the side wall surface of the discharge side portion of the spiral groove and the side surface of the gate gradually increasing as the gate disposed in the spiral groove comes closer to the terminal end of the spiral groove.

2. The single-screw compressor of claim 1, wherein a clearance between a bottom wall surface of the discharge side portion of the spiral groove and a tip surface of the gate disposed in the spiral groove is larger than a clearance between the bottom wall surface of the suction side portion of the spiral groove and the tip surface of the gate disposed in the spiral groove.

* * * * *